US005490821A

United States Patent [19]

Wu

[11] Patent Number: 5,490,821

[45] Date of Patent: Feb. 13, 1996

[54] MASSAGE DEVICE FOR THE SOLES OF THE FEET

[76] Inventor: Otto Wu, Room 918, 15 Fu Hsing N. Road, Taipei, Taiwan

[21] Appl. No.: 140,324

[22] Filed: Oct. 22, 1993

[51] Int. Cl.[6] ..... A61H 7/00

[52] U.S. Cl. ..... 601/134; 15/215; 5/651

[58] Field of Search ..... 15/161, 215, 216, 15/217; 128/25 B, 59–62 R, 33; 52/588, 593, 594, 177; 5/900.5, 901, 652, 651, 417, 420

[56] References Cited

U.S. PATENT DOCUMENTS

| | | | |
|---|---|---|---|
| 2,476,921 | 7/1949 | Shock | 128/25 B X |
| 3,100,483 | 8/1963 | Altmeyer et al. | 128/60 |
| 3,434,715 | 3/1969 | Brantingham et al. | 5/417 |
| 3,681,797 | 8/1972 | Messner | 5/900.5 X |
| 3,885,555 | 5/1975 | Nobbs | 128/25 B |
| 3,974,532 | 8/1976 | Ecchuya | 5/900.5 X |
| 4,329,981 | 5/1982 | Dungl | 128/25 B |
| 4,422,194 | 12/1983 | Viesturs et al. | 5/900.5 X |
| 4,468,910 | 9/1984 | Morrison | 52/177 X |
| 4,584,221 | 4/1986 | Küng | 52/177 X |
| 4,596,731 | 6/1986 | Cudmore et al. | 52/177 X |
| 4,807,412 | 2/1989 | Frederiksen | 52/177 |
| 4,952,434 | 8/1990 | Rumsey et al. | 15/215 |
| 5,100,716 | 3/1992 | Juneau | 5/417 |
| 5,134,740 | 8/1992 | Summer | 5/652 |
| 5,158,073 | 10/1992 | Bukowski | 128/25 B |
| 5,254,039 | 10/1993 | Garcia | 5/420 X |

FOREIGN PATENT DOCUMENTS

| | | | |
|---|---|---|---|
| 2123696 | 2/1984 | United Kingdom | 128/25 B |

*Primary Examiner*—Robert A. Hafer
*Assistant Examiner*—Brian E. Hanlon
*Attorney, Agent, or Firm*—Morton J. Rosenberg; David I. Klein

[57] ABSTRACT

A massage device for the soles of the feet is provided. The device includes a number of units releasably connected together to form a long track which allows people to walk thereon and have the soles of their feet massaged by pebble-like projections formed on each of the units. Each unit includes a rectangular, flat, hollow body defining a sealed interior space inflated by air. The flat body has an upper surface having a plurality of different-sized pebble-like projections distributed uniformly thereon. The hollow body is preferably made of a resilient and slightly inflatable material so that by being inflated, the interior pressure is adjusted to provide an adjustable rigidity of the body. With the resilience and the adjustable rigidity provided by the interior pressure, the pebble-like projections are allowed to deflect and deform when stepped on by people, to comply with the shape of the soles of the feet, so as to avoid damaging the soles. Bosses and holes are provided on respective edges of the flat hollow body to allow one unit to be connected to another by having the bosses of one received and engaged by the holes of the other.

5 Claims, 3 Drawing Sheets

MASSAGE DEVICE FOR THE SOLES OF THE FEET

FIELD OF THE INVENTION

The invention relates generally to a massage device for the sole of the foot which has a plurality of floating projections to massage the sole of the foot when a person walks on the massage device.

BACKGROUND OF THE INVENTION

Walking on a pebble route to allow the pebbles to massage the soles of the feet and stimulate the nerve system of the feet is a well-known informal therapeutic method. The principle of the therapy is based on traditional Chinese medicine in which the human body is considered full of "cavities" under the skin and by stimulating these "cavities", the human body can increase its ability of restoring health. Acupuncture, which is well accepted as a useful therapy, is an example of the application of such a "cavity" principle.

Although further experimentation may still be needed to prove the "cavity" principle, massage of the soles of the feet by stimulating the "cavities" located therein is still very important for health. This is because the soles of the human feet are subject to daily constraint within the limited space provided by shoes, especially for those living in urban areas. Thus, the soles of the feet are under great strain which should be suitably released, for example, by massage to keep the feet healthy.

Massaging the soles of the feet to release the pain and strain that such soles are subject to is very useful. Thus, it is more popular nowadays that people use the foot massage devices to massage and release the strain of the soles of the feet.

The foot massage device of the previously-mentioned kind may have a flat base on which a plurality of upward projections, in the form of pebbles, are mounted. A person walks on this structure so as to have the soles of his or her feet massaged by the pebble-like projections. An example of such a prior art structure is shown in FIG. 3 of the accompanying drawings, in which a number of pebbles of suitable sizes are partially buried in a solid substrate, and thus fixed in the ground for people to walk thereon with bare feet.

A disadvantage of such a fixed pebble massage device is that the pebbles are not floating. The pebbles are not movable to comply with the size and shape of each individual's feet that step on them, so that damage may be caused by excessive stimulation of the soles by the fixed pebbles.

Further, since the pebbles are generally not resilient, they may cause injury to people falling down on them, especially for the knees and the elbows.

Another disadvantage of such a fixed type foot sole massage device is that it requires quite a large space to lay and fix the pebbles, for example, to form a pebble route of a substantial length in a park. Such a fixed device is difficult to move to desired locations.

It is therefore desirable to provide a massage device for the soles of the feet of such kind which overcomes the deficiencies of the conventional fixed type foot massage device.

SUMMARY OF THE INVENTION

The principal objective of the present invention is to provide a massage device for the soles of the feet of the above-mentioned kind which has a simple structure so that it can be easily assembled indoors or outdoors.

It is another objective of the present invention to provide a massage device for the soles of the feet of the above-mentioned kind which is easy to assemble and disassemble and can be stored in a compact manner without occupying a large space prior to installing such a device.

It is a further objective of the present invention to provide a massage device for the soles of the feet of the above-mentioned kind which is made of a resilient and slightly inflatable material with a sealed interior space so as to allow the pebble-like projections thereof to be deflectable and deformable, to comply with the shape of the soles of each individual and thus avoid damaging the soles of the feet of a user.

It is a further objective of the present invention to provide a massage device for the soles of the feet of the above-mentioned kind which is composed of a number of rectangular units releasably connected together so that easy assembly and disassembly can be achieved.

To achieve the above-mentioned objectives, there is provided a massage device for the soles of the feet comprising a number of units releasably connected together to form a long track which allows people to walk thereon to have the soles of the feet massaged by pebble-like projections formed on each of the units. Each unit comprises a rectangular, flat, hollow body defining a sealed interior space therein to be inflated by air. The flat body has an upper surface having a plurality of different-sized pebble-like projections uniformly distributed throughout the surface. The hollow body is preferably made of a resilient and slightly inflatable material so that by being inflated, the interior pressure is adjusted to provide an adjustable rigidity of the body. With the resilience and the adjustable rigidity provided by the interior pressure, the pebble-like projections are allowed to deflect and deform when stepped on by people to comply with the shape of the soles of the feet stepping thereon so as to avoid damaging the soles. Bosses and holes are provided on opposing edges of the flat hollow body to allow one unit to be connected to another unit by having the bosses of one received and engaged by the holes of the other.

BRIEF DESCRIPTION OF THE DRAWINGS

Other objectives and advantages of the invention will be apparent from the following description of a preferred embodiment of the present invention taken in connection with the accompanying drawings wherein.

DETAILED DESCRIPTION OF THE PREFERRED EMBODIMENTS

Figure 2:
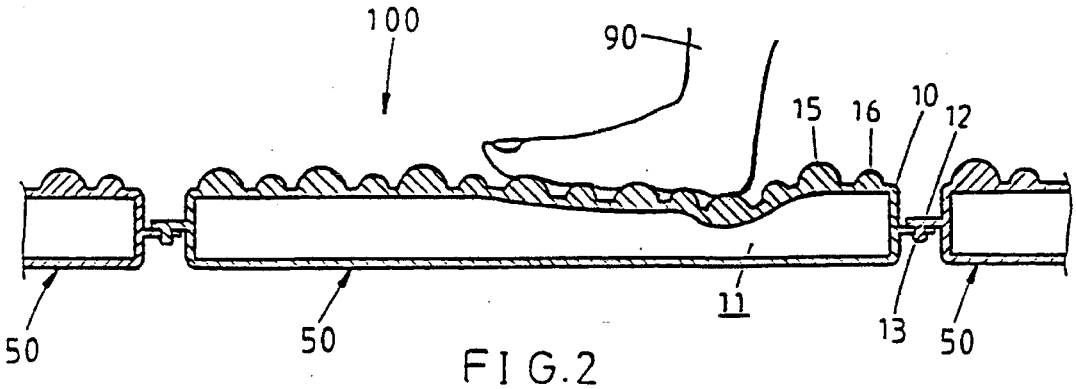
FIG. 2 is a cross-sectional view showing a number of the massage units for the soles of the feet connected together to form a track on which people can walk for massage of the foot soles.
Figure 3:
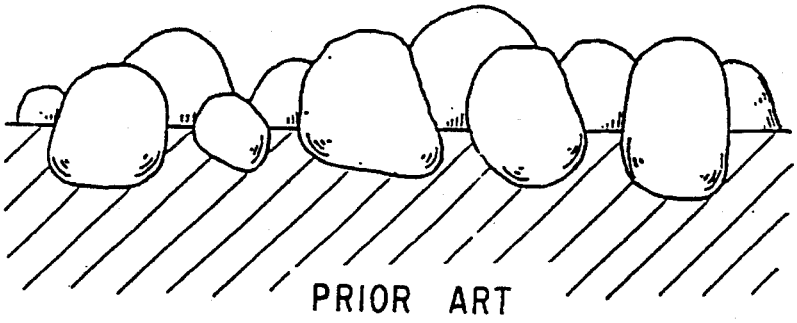
FIG. 3 is a cross-sectional view showing a conventional fixed type massage device for the soles of the feet in which pebbles of suitable sizes are partially buried and thus fixed in the ground.

With reference to the drawings and in particular to FIG. 2, there is shown a massage device for the soles of the feet constructed in accordance with the present invention, generally designated by the reference numeral 100. As shown, a bare foot 90 steps on the massage device 100. Massage device 100 is composed of a number of single units 50 releasably connected together to form a long track, as shown in FIG. 5, to allow a user to walk thereon.

Figure 1:
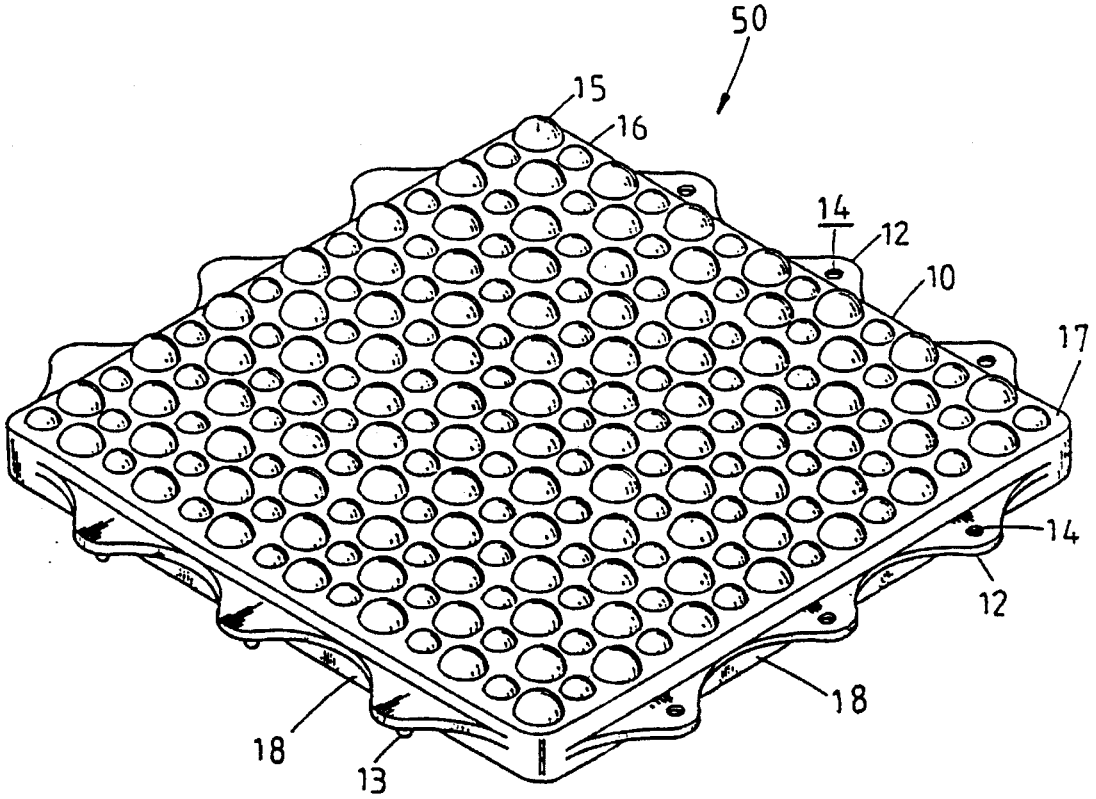
FIG. 1 is a perspective view showing a unit of a massage device for soles of the feet constructed in accordance with the present invention.
Figure 5:
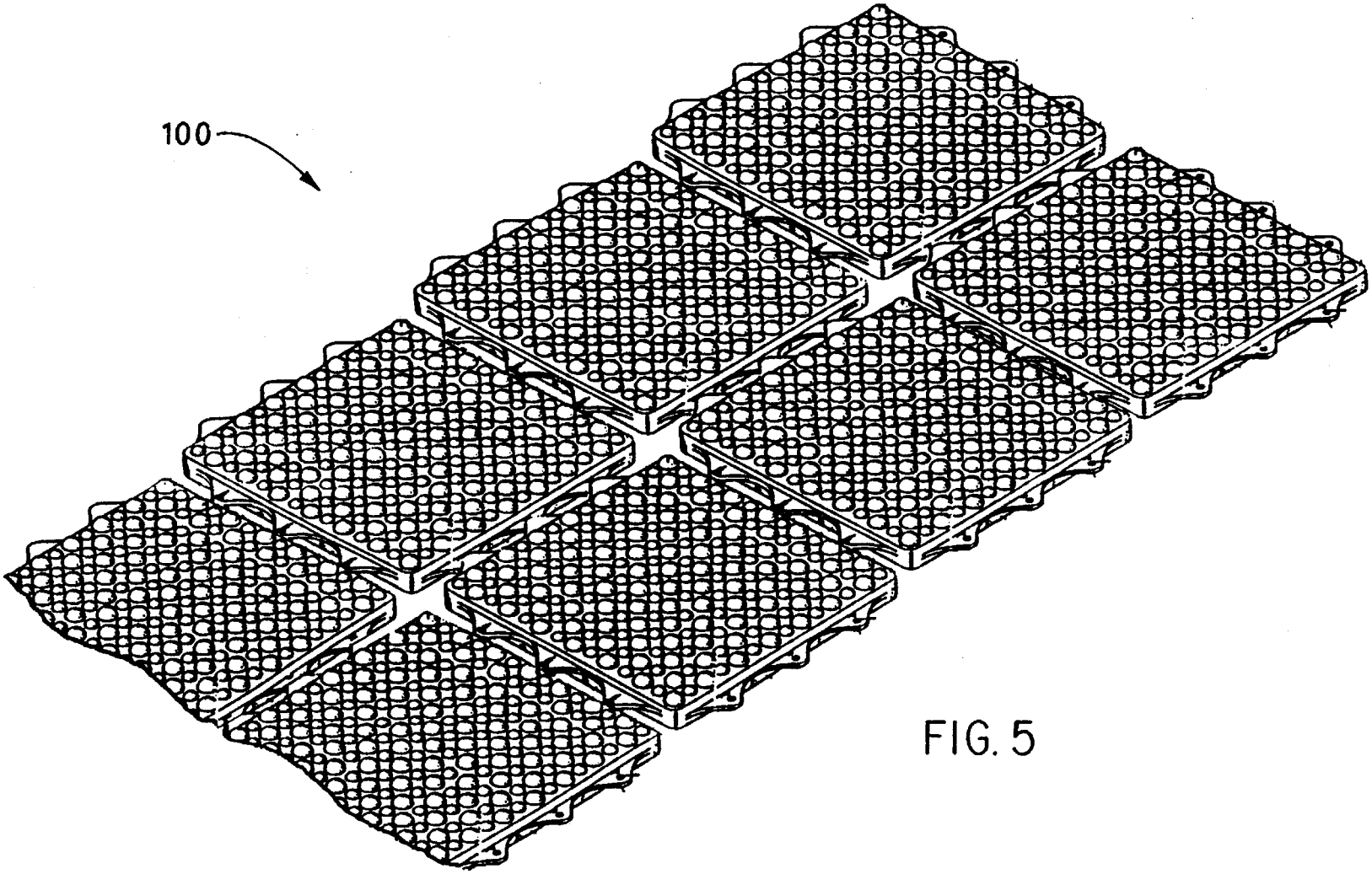
FIG. 5 is a perspective view showing a number of units of the present invention connected together.

With particular reference to FIG. 1, wherein a single unit 50 of the massage device 100 shown in FIGS. 2 and 5 is illustrated in a perspective manner, the unit 50 comprises a resilient body 10. Body 10 is preferably a substantially hollow, flat rectangular member defining an air tight interior space 11 (shown in FIG. 2) enclosed therein, into which air is pumped to provide an interior pressure.

The flat hollow body 10 has an upper surface 17 on which a number of pebble-like solid projections 15 and 16 are formed. These projections are partially projecting out of the upper surface 17 and supported in a floating manner by the air inside the interior space 11. The pebble-like projections may have a variety of different sizes and preferably, there are two different sizes 15 and 16 uniformly disposed throughout the whole upper surface 17 in an alternating manner, as shown in the drawings. It is however understood that the solid pebble-like projections 15 and 16 may be distributed on the upper surface 17 in a random manner and with a combination of projections of more than two sizes.

In the embodiment illustrated in the drawings, the rectangular body 10 has two pairs of opposite edges 18. In each pair of the opposite edges, one of the edges has a first connecting means 13 formed thereon and the other has a second connecting means 14 thereon. The second connecting means 14 of one rectangular body 10 is releasably engageable with a first connecting means 13 of another rectangular body 10, so as to allow it to form a long track 100 by connecting a number of units 50 together with the first connecting means of a first unit engaged with the second connecting means of a second unit, as shown in FIGS. 2 and 5.

Preferably, each of the edges 18 has a side flange 12 formed thereon on which either the first or the second connecting means 13 or 14 is formed. An example of the first connecting means 13 comprises a number of bosses, preferably three, extending from the bottom surface of respective side flanges 12. Correspondingly, the second connecting means 14 comprises a respective number of holes 14 formed through the side flanges 12 disposed on opposing sides of the body 10, with respect to the side flanges having bosses.

Figure 4:
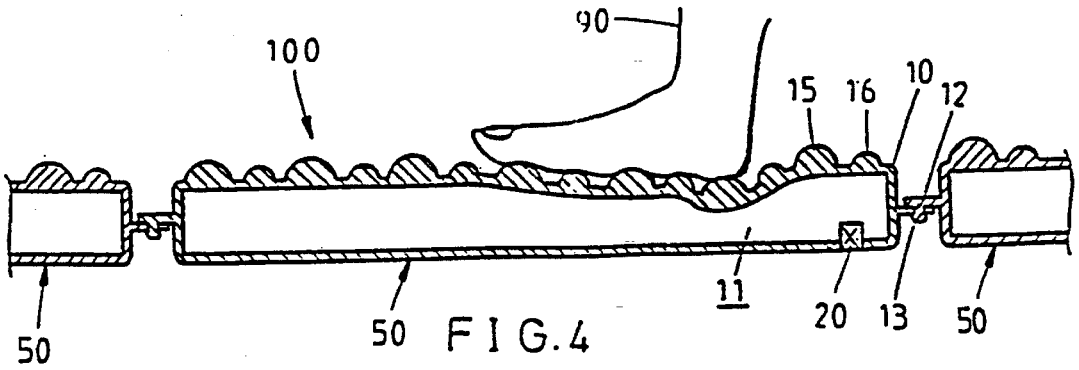
FIG. 4 is a cross-sectional view of the massage device for the soles of the feet of the present invention showing an inflation valve mounted thereon for inflating and/or deflating the foot sole massage device.

With particular reference to FIG. 4, a second embodiment of the present invention is illustrated. In this embodiment, the hollow body 10 is made of a slightly inflatable material, with an inflation valve 20 mounted therein to allow the hollow body 10 to be inflated and/or deflated. Thus, the interior pressure can be adjusted and thereby the rigidity of the body 10 is predetermined by the selected interior pressure. This allows the hollow body 10 to be stored in a more compact manner by evacuating the interior space 11.

It is apparent that although the invention has been described in connection with the preferred embodiments, those skilled in the art may make changes to certain features of the preferred embodiments, such as using a square or rhombic hollow body to replace the rectangular hollow body described herein, without departing from the spirit and scope of the invention as defined in the appended claims.

What is claimed is:

1. A massage device for the soles of the feet comprising a plurality of massage units releasably coupled one to another to form a track upon which a user walks, each of said plurality of massage units including:

a hollow body formed of a resilient air impervious material and having an upper surface for supporting a user's feet, said hollow body having a single air filled enclosed interior cavity for establishing a predetermined rigidity of said upper surface;

a plurality of first projections formed in a uniform distribution on said upper surface of said hollow body, each of said plurality of first projections being formed of a solid material composition having a pebble-like contour, each of said plurality of first projections extending a first predetermined height from said upper surface;

a plurality of second projections formed in a uniform distribution on said upper surface of said hollow body in alternating relation with respect to said plurality of first projections, each of said plurality of second projections being formed of a solid material composition having a pebble-like contour, each of said plurality of second projections extending a second predetermined height from said upper surface, said second predetermined height being greater than said first predetermined height; and, means for releasably coupling one of said plurality of massage units to another of said plurality of massage units; said releasable coupling means includes a plurality of first side flange members extending from at least one side of said hollow body and a plurality of second side flange members extending from an opposing side relative to said at least one side of said hollow body, each of said plurality of first side flange members having a boss extending from a lower surface thereof, each of said plurality of second side flange members having a through opening formed therein for receipt of a respective boss of a first side flange member of another of said plurality of message units.

2. The massage device as recited in claim 1 where each of said plurality of massage units further includes means coupled to said hollow body for adjusting said rigidity of said upper surface.

3. The massage device as recited in claim 2 where said rigidity adjustment means includes an inflation valve coupled to an opening formed through a wall of said hollow body for selectively adding or removing air from said enclosed interior cavity.

4. The massage device as recited in claim 1 where said plurality of first side flange members includes three first side flange members extending from at least one side of said hollow body.

5. The massage device as recited in claim 4 where said plurality of second side flange members includes three second side flange members extending from at least one side of said hollow body opposite said side from which said three first side flange members extend.

* * * * *